United States Patent [19]

Reif

[11] 4,010,011

[45] Mar. 1, 1977

[54] ELECTRO-INERTIAL AIR CLEANER

[75] Inventor: Robert B. Reif, Grove City, Ohio

[73] Assignee: The United States of America as represented by the Secretary of the Army, Washington, D.C.

[22] Filed: Apr. 30, 1975

[21] Appl. No.: 573,291

[52] U.S. Cl. ..... 55/127; 55/155

[51] Int. Cl.[2] ..... B03C 3/14

[58] Field of Search ..... 55/108, 117, 126, 127, 55/140, 155, 457, DIG. 38, 146, 157, 148

[56] References Cited

UNITED STATES PATENTS

| | | | |
|---|---|---|---|
| 1,650,097 | 11/1927 | Schmidt | 55/155 X |
| 2,351,089 | 6/1944 | Abbey | 55/108 X |
| 2,594,805 | 4/1952 | Rommel | 55/127 |
| 2,660,559 | 11/1953 | Prime | 55/DIG. 38 |
| 2,748,888 | 6/1956 | Hodson | 55/127 |
| 3,030,755 | 4/1962 | Farr et al. | 55/457 |
| 3,110,580 | 11/1963 | Strubler | 55/155 |
| 3,581,468 | 6/1971 | Gourdine et al. | 55/155 X |
| 3,611,679 | 10/1971 | Pall | 55/457 |
| 3,650,092 | 3/1972 | Gourdine et al. | 55/155 |
| 3,670,479 | 6/1972 | Tomlinson | 55/457 X |
| 3,717,977 | 2/1973 | Stone | 55/155 X |
| 3,718,029 | 2/1973 | Gourdine et al. | 55/155 |

FOREIGN PATENTS OR APPLICATIONS

| | | | |
|---|---|---|---|
| 1,089,525 | 11/1954 | France | 55/127 |

*Primary Examiner*—Frank W. Lutter
*Assistant Examiner*—David L. Lacey
*Attorney, Agent, or Firm*—Peter A. Taucher; John E. McRae; Nathan Edelberg

[57] ABSTRACT

An engine air cleaner comprising a flow tube approximately one and one half inch in diameter for conveying dust-laden air at a rate of approximately 40 c.f.m. Swirl means in the mouth of the tube produces outward migration of the dust particles in the air stream; an ionizer wire within the tube produces ions which charge the particles to accelerate the outward migration tendencies, especially of the sub-5-micron particles. Concentrated dust is removed from the peripheral area near the tube wall by a scavenger air flow that is approximately 10% of the total flow. The tube wall may be kept relatively clean by means of a special dielectric layer on the tube inner surface.

1 Claim, 3 Drawing Figures

ELECTRO-INERTIAL AIR CLEANER

BACKGROUND AND SUMMARY OF THE INVENTION

It is known to form an engine air cleaner as a bank of straight flow tubes, each tube having swirl means at its mouth to cause dust to be centrifugally thrown outwardly toward the tube wall. Dust near the tube wall is drawn from the main stream by a "scavenger" fan; cleaned air is taken from the core zone of the tube through a small diameter take-off tube extending into the downstream end of the flow tube.

The centrifugal separator action is relatively ineffective on particles smaller than 5 microns; therefore it has been proposed to add electrostatic separator action to enhance overall collection efficiency. In one arrangement an ionizer wire negatively charged to approximately 15–20 KV is extended through the tube on the tube centerline; the tube wall is at ground potential to establish a radiating flow of particle-charging negative ions. The resultant negative charges on the particles and the radial electrical field from the ionizer wire to the tube accelerate or enhance outward migration tendencies, especially of the smaller particles, thereby improving overall collection efficiency.

The electrostatic separator action causes some particles to precipitate and adhere rather strongly to the tube side wall. Therefore it was necessary to periodically rap or vibrate the tube in the radial and/or axial direction in order to dislodge the particles sufficiently to permit the scavenger air to carry them away. Under some circumstances the particles were jarred with such force as to be re-entrained into the clean air stream; at other times the collected particles resisted the jarring forces to prevent fluidization into the scavenger stream. Even when properly applied, rapping or vibrating requires special shock mounting of the tube; mechanical wear on the mounts is a problem. Therefore, the use of rappers as a dislodging expedient is not entirely satisfactory.

The present invention provides means for removing collected particles from the tube surface without the necessity for rapping or vibrating the tube. Instead the "removing force" comprises a dielectric layer on the inner surface of the tube. Experiments indicate that such a layer tends to weaken the attractive forces between the grounded metal surface and the collected particles sufficiently to enable the areodynamic forces to have the desired scavenging action without the need for rapping.

THE DRAWINGS

FIG. 1 fragmentarily illustrates an air cleaner incorporating the invention.

FIG. 1 IN MORE DETAIL

Figure 1:
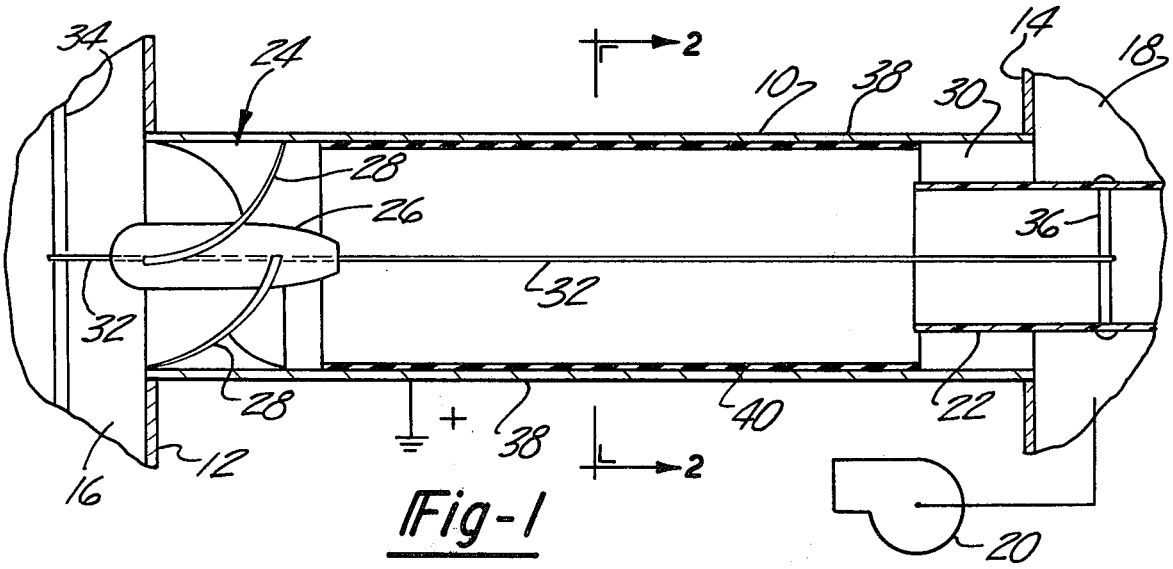
Figure 2:
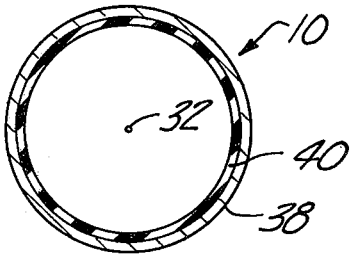
FIG. 2 is a sectional view on line 2—2 in FIG. 1.
Figure 3:
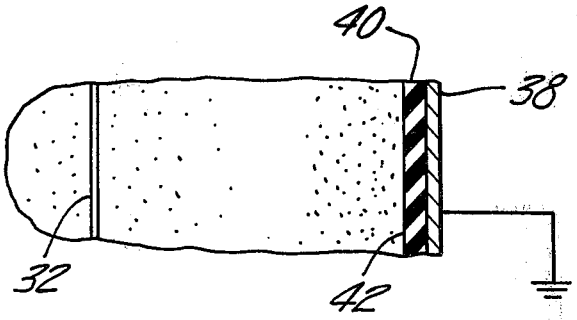
FIG. 3 is a blown-up section of FIG. 1 to illustrate electrostatic action.

FIG. 1 fragmentarily illustrates an engine air cleaner comprising a flow tube 10 extending between tube sheets 12 and 14. Space 16 to the left of sheet 12 represents the ambient atmosphere; space 18 to the right of sheet 14 represents a scavenger chamber that communicates with a small induced draft fan 20 driven by the engine or its electrical system to remove concentrated dust from the air cleaner tube 10.

A clean air take-off pipe 22 extends from a non-illustrated tube sheet into the flow tube 10 to convey clean air to the engine; the engine can be a turbine engine, or piston engine (diesel or gasoline). In the case of a piston engine the intake manifold vacuum provides the principal motive force for drawing air from space 16 through the air cleaner (assuming no supercharging); fan 20 merely provides a scavenger action for the concentrated dust moving along the outer boundary zone near the wall of tube 10. Normally fan 20 would be sized to draw off about 10% of the total air flow supplied to tube 10. The remaining 90% (substantially cleaned of particulates) would be drawn through pipe 22 into the engine.

Tube 10 can have a length on the order of six to ten inches and a diameter on the order of one and one-half inch. Flow rate can be approximately 40 cubic feet per minute. Depending on the size of the engine, the number of flow tubes in a complete air cleaner can vary from about five to one hundred or more; the tubes would be arranged as a tube "bank" between tube sheets 12 and 14.

Each tube 10 is provided at its inlet mouth with a swirl or spinner means 24, shown as a hub 26 equipped with one or more spiral vanes 28 for imparting circumferential swirl to the dusty gas as it moves downstream toward pipe 22. In one case the swirl means comprised four equally spaced vanes, each extending around the hub for slightly more than one quarter revolution at an average attack angle of about 55° relative to the hub axis.

Swirl imparted to the gas tends to centrifugally concentrate the dust particles in the outer annular zone of the flow stream, i.e. near the tube 10 wall. Fan 20 is thereby able to remove dust concentrates through the annular passage 30 formed between the inner surface of tube 10 and the outer surface of clean air pipe 22. The axial spacing between pipe 22 and spinner vanes 28 is determined to a certain extent by the angularity of the spinner vanes and the diameter of hub 26. The axial spacing should be sufficient for all of the gas to make between one and two revolutions before reaching the plane of the clean air tube mouth; assuming a sufficient liner velocity of the stream in the annular zone near the surface of hub 26, dust particles in that hub zone will then have the required residence time in the axial space to be centrifugally shifted outwardly toward the tube wall for separation from the clean air stream. In general, the axial space between the spinner means and clean air pipe may be decreased by increasing the pitch angle of the vanes and by increasing the hub diameter. A compromise must be made to avoid excessive pressure drop.

Average collection efficiency of this so-called "interial" separator is usually about 80–85%, although for the sub-5-micron particles size range it is considerably less; i.e. inertial separation is generally effective on large particles, say above five microns, but not nearly so effective on the smaller particles. Because of the relatively low collection efficiency obtained with inertial separator action the FIG. 1 collector includes an add-on electrical collection means which comprises an electrically charged ionizer wire 32 stretched taut between a high voltage rod or terminal 34 located in space 16 and an anchor pin or web 36 running transversely across pipe 22. Pipe 22 is formed of dielectric material to prevent short circuiting of the high voltage.

Wire 32 runs through an axial opening in hub 26; the hub is therefore formed of dielectric material.

A negative voltage, preferably in the range of 15–30 KV, is applied to terminal 34 to provide the necessary charge on ionizer wire 32. The wire diameter is kept reasonably small, e.g. 0.008 inch, to provide corona discharge in the space between wire 32 and the tube wall. The tube wall in this instance is formed as a two layer structure consisting of an outer metallic conductive layer 38 and an inner dielectric layer 40. In an experimental device conductive layer 38 was stainless steel having a wall thickness of about 0.038 inch, and dielectric layer 40 was Pyrex glass having a thickness of about 0.060 inch. A ground connection is made to conductor 38 to provide the necessary "sink" for electrons constituting the corona discharge.

The electrostatic action is such that corona at wire 32 produces negative ions in the gas, which ions subsequently charge the entrained particles negatively, causing them to migrate outwardly in the electrical field between the wire and tube wall. This outward migration is additive to the outward particle migration due to swirl means 24; i.e. both actions occur simultaneously and in the same direction. In general, the outward migration velocity of the larger particles due to the swirl is increased by reason of ionizer wire 32; the principal advantage of the ionizer wire is however its effect on the smaller particles which might be relatively immune to inertial (swirl) influences. The addition of the ionizer wire raises overall collector efficiency above ninety per cent.

A difficulty arises because the electrostatic deposition of the particles tends to make them adhere on the flow tube surface. Fan 20 therefore has difficulty in removing the collected particles from the air cleaner. In a device similar to that shown in FIG. 1, but without dielectric layer 40, it was in fact impossible to remove dust accumulations on the tube 10 surface except by the use of a vibratory rapper. In the experimental apparatus the rapper was arranged about three fourths of the distance along tube 10 in a "transverse" orientation for applying a vibrating force at right angles to the tube wall. The tube had a diameter of about one and one half inch, a length of approximately six inches (between the spinner and clean air take-off tube) and a total flow of 40 c.f.m; dust loading was about 0.025 gram per c.f.m. By using a pneumatic rapper operating at a frequency of 100–300 cycles per second it was possible in some cases to sufficiently disturb the collected particles so that scavenger fan 20 could keep the inside surface of the flow tube reasonably clean. However it is suspected that occasionally the rapping may have caused re-entrainment of collected particles into the clean air stream.

The vibrating rapper added complexity and cost to the apparatus as well as a possible reduction in estimated service life (due to experienced failure of the vibration mounts). Therefore the flow tube was lined with a dielectric layer 40 and put back into operation without the rapper; i.e. the rapper was unclamped from the tube. Preliminary tests with the modified tube showed no measurable dust accumulations on the inner surface 42 of the flow tube after a representative period of operation. The overall collection efficiency did however drop from about 98% to about 92%. Operating at about 15 KV electrical input the "modified" FIG. 1 unit consumed negligible current, whereas the same unit without dielectric layer 40 consumed about 0.9 milliampere; apparently the dielectric had an adverse effect on the ion flow toward grounded conductor 38.

Units not having the dielectric layer 40 were found to have increased dust build-ups on the flow-tube surface in accordance with increases in applied voltage. Thus, operation of the non-lined unit at 18 KV produced greater dust build-ups than operation at 14 KV. Presumably the larger dust build-ups were due to increased charging of the particles, and correspondingly higher field force tending to deposit and hold the charged particles on the tube surface. Once firmly deposited, surface molecular forces hold the fine particles tightly on the tube surface; charges on the individual particles drain to ground, but the charge on the surface of the collected particulate layer is replenished by the corona ions.

When the inner surface of the flow tube was formed by a dielectric layer, as in FIG. 1, negative ions collected on the inner surface 42; the resultant high charge lever decreased the field forces tending to deposit and hold the like charged particles on the tube surface. Thus the surface bonding forces never developed. The ultimate effect was a weakly-held dust layer that was more susceptible to aerodynamic fluidization by fan 20.

The exact material used for the dielectric is not believed critical; I used Pyrex glass. The thickness of the dielectric layer should presumably be a function of the material's dielectric constant and the effect that the thickness has on the potential that develops on the inner surface of the tube. The dielectric layer obviously cannot be such a complete insulator as to halt electron flow to ground as the potential of the inner wall would rise until the potential drop from the wire to the wall would be insufficient to produce corona from the wire.

I wish it to be understood that I do not desire to be limited to the exact details of construction shown and described for obvious modifications will occur to a person skilled in the art.

I claim:

1. An air cleaner comprising a cylindrical flow tube having an inlet end for receiving dust-laden air, said flow tube also having an outlet end for discharging clean air and concentrated dust therethrough;

air spinner means within the inlet end of the flow tube for imparting circumferential swirl to the dust-laden air, whereby dust particles in the air stream are caused to migrate toward the tube wall as the stream moves toward the tube outlet end;

a clean air take-off pipe extending into the outlet end of the flow tube for directing clean air out of the tube to an engine, said pipe having a smaller diameter than the flow tube whereby concentrated dust is enabled to flow through the annular space between the pipe and flow tube; suction means communicating with the annular space for promoting dust concentrate flow therethrough;

said air spinner means and clean air take-off pipe being formed of dielectric material; said take-off pipe having a wire anchorage connected therein;

means for imparting an electrical charge to the flowing dust particles, comprising a negatively charged ionizer wire located on the longitudinal axis of the flow tube, said wire extending through the spinner means along the length of the flow tube and connected to said anchorage in the clean air take-off pipe to provide particle-charging corona along the entire length of the flow tube; means grounding the tube wall to maintain a particle-ionizing potential between the wire and wall; said tube wall being comprised of an outer conductive layer and an inner dielectric layer; said dielectric layer having sufficient thickness as to significantly weaken the electrostatic attractive force between the outer conductive layer and dust particles deposited on the surface of the dielectric layer, whereby aerodynamic forces are enabled to continuously move the deposited particles through the aforementioned annular space without allowing them to remain on the dielectric surface; said flow tube having an internal diameter of about one and one half inch, and said dielectric layer being Pyrex glass having a thickness of approximately one sixteenth inch.

* * * * *